US010543393B2

(12) United States Patent
Ross

(10) Patent No.: US 10,543,393 B2
(45) Date of Patent: Jan. 28, 2020

(54) SUSPENSION TRAINER

(71) Applicant: Exemplar Design, LLC, Mason, OH (US)

(72) Inventor: Adam L. Ross, Mason, OH (US)

(73) Assignee: EXEMPLAR DESIGN, LLC, Mason, OH (US)

( * ) Notice: Subject to any disclaimer, the term of this patent is extended or adjusted under 35 U.S.C. 154(b) by 82 days.

(21) Appl. No.: 15/818,107

(22) Filed: Nov. 20, 2017

(65) Prior Publication Data

US 2018/0140894 A1 May 24, 2018

Related U.S. Application Data

(60) Provisional application No. 62/424,136, filed on Nov. 18, 2016.

(51) Int. Cl.

| | |
|---|---|
| ***A63B 21/00*** | (2006.01) |
| ***A63B 21/068*** | (2006.01) |
| ***A63B 21/16*** | (2006.01) |
| ***A63B 23/12*** | (2006.01) |
| ***A63B 21/08*** | (2006.01) |

(52) U.S. Cl.
CPC ..... *A63B 21/4035* (2015.10); *A63B 21/068* (2013.01); *A63B 21/08* (2013.01); *A63B 21/1663* (2013.01); *A63B 23/1209* (2013.01); *A63B 2209/00* (2013.01); *A63B 2209/10* (2013.01); *A63B 2225/09* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,497,641 | B1 * | 12/2002 | Hinds | A63B 21/00043 482/121 |
| 6,663,544 | B2 * | 12/2003 | Hinds | A63B 21/0004 482/121 |
| 2002/0187884 | A1 * | 12/2002 | McGrath | A63B 21/0552 482/121 |
| 2013/0165301 | A1 * | 6/2013 | Thrasher-Rudd | A63B 7/00 482/129 |
| 2017/0050082 | A1 * | 2/2017 | Whitaker | A63B 22/0005 |

* cited by examiner

*Primary Examiner* — Jennifer M Deichl
(74) *Attorney, Agent, or Firm* — Baker Hostetler

(57) ABSTRACT

A suspension trainer including a handle system comprised of a ring element and a removable strap element.

3 Claims, 4 Drawing Sheets

SUSPENSION TRAINER

CROSS REFERENCE TO RELATED APPLICATIONS

The present application claims priority from U.S. Provisional Application Ser. No. 62/424,136 filed on Nov. 18, 2016 entitled Suspension Trainer, the contents of which are herein incorporated by reference.

TECHNICAL FIELD

The present disclosure generally pertains to exercise apparatuses, such as elongate exercise apparatuses, comprising bands including handle portions for use in suspension training applications and the like. More particularly, the present disclosure pertains to a handle system for use in connection with such a band type exercise apparatus useable in multiple configurations.

BACKGROUND

Elongate exercise apparatuses of the type used for suspension training, both using elastic and inelastic straps, are known. Typically suspension trainers are comprised of one or more handles connecting to suspension elements that the user grasps onto in order to perform upper body exercises. The user is able to vary the difficulty of the workout while using the suspension trainer by varying the extent of the user's body weight that the user is working against. Typically, the extent of the body weight is determined by the angle at which the user is positioned relative to the floor, the elasticity (if any) of the suspension elements, or a combination of the two.

Suspension trainers have been considered very useful by the exercise community for years given the multitude of different exercises they can be used for and the multitude of different muscle groups that can be isolated depending on how they are attached to the static connection and how they are engaged with by the user. Indeed, depending on the exercise and handles provided, a user may engage the trainers with hands (including various grips), elbows shoulders and even the feet and legs.

In this regard, known suspension trainers do have some limitations. For example, in order to attempt to accommodate different exercises, known suspension trainers often are supplied with adjustable straps. However, such prior art suspension trainers are generally supplied with permanently connected foot/hand attachments and generally comprise only one of either a ring or strap-type handle. This is problematic in that while both ring and strap-type handles are each useful for some specific grips/exercises, neither is useful for efficiently completing all such exercises.

Accordingly, it would be desirable to have a durable, versatile suspension trainer capable of providing a user with a total body workout and meeting the needs of a wide range of users that have different strengths, limitations, and physical fitness levels. More specifically, it would be desirable to have a suspension type trainer including a handle system that is capable of simultaneously providing the advantages of both ring and strap-type handles.

SUMMARY

In accordance with the disclosure, suspension trainers of the type used for body weight resistance training are generally disclosed. More specifically, the present disclosure comprises suspension trainers capable of providing users with total body workouts meeting the needs of a wide range of users that have different strengths, limitations, and physical fitness levels.

In one embodiment of the disclosure, a suspension trainer having a combination ring and strap handle system is disclosed. In other embodiments, the suspension trainer may include elastic or inelastic elongate members and the handle system may be permanently attached or removably attached thereto. In accordance with the disclosure, the suspension trainers disclosed herein may be made through molding and fabrication as would be known in the art.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope. The disclosure will be described with additional specificity and detail through use of the accompanying drawings.

DETAILED DESCRIPTION

Figure 1:
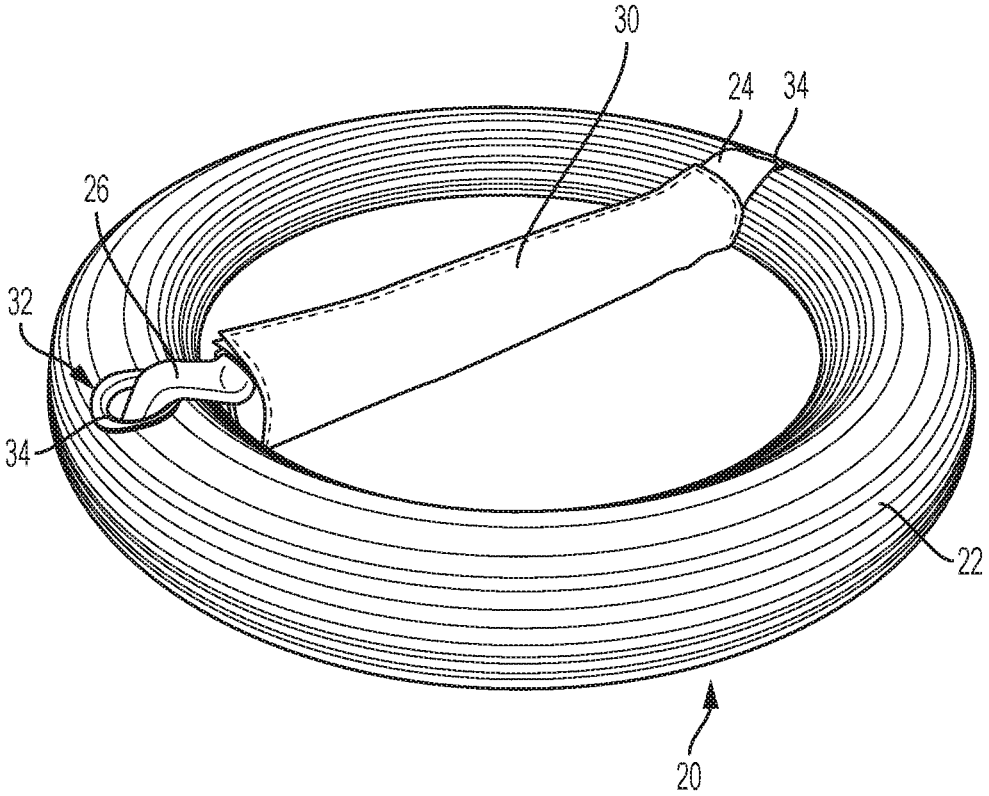
FIG. 1 is a side perspective view of an exemplary handle system for use in connection with a suspension trainer in accordance with one aspect of the disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

Figure 3:
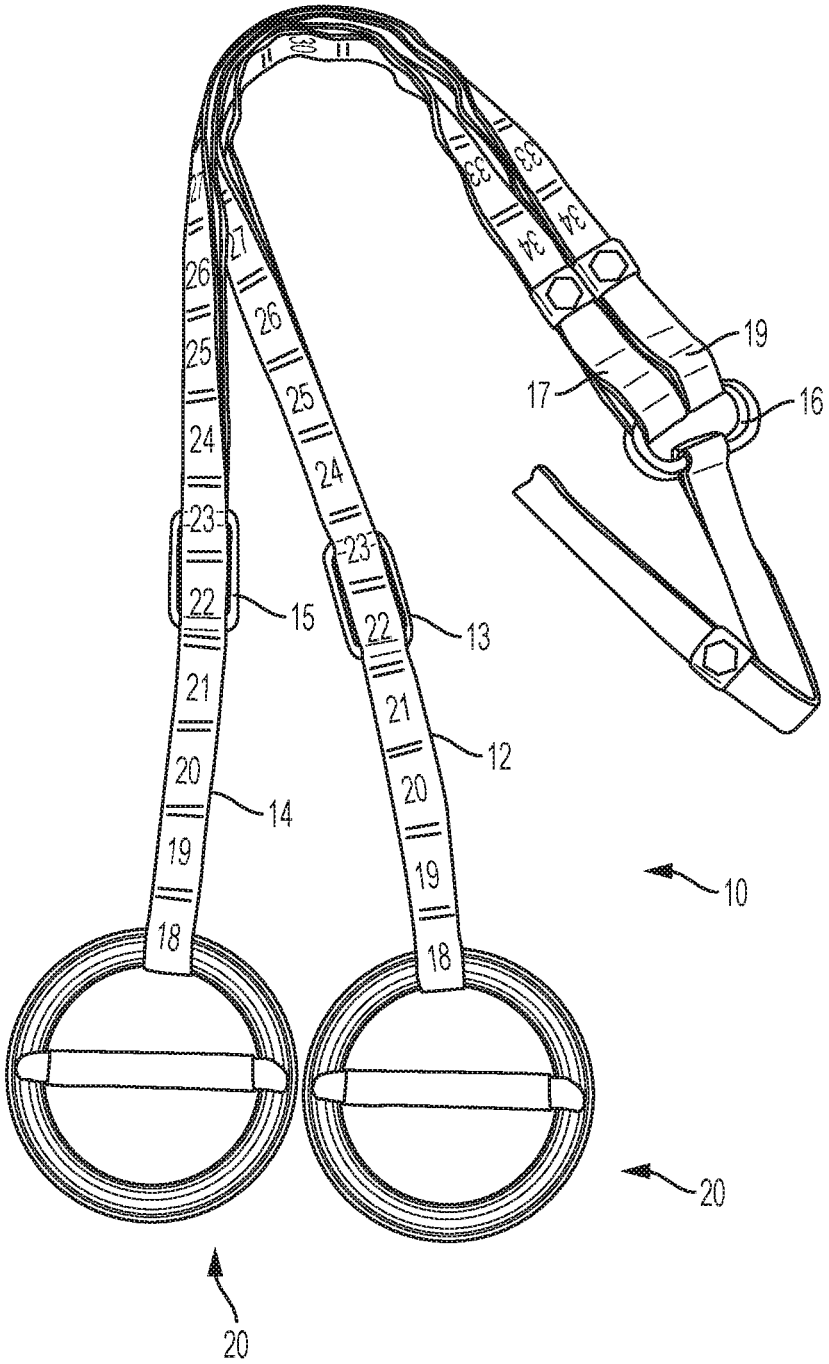
FIG. 3 is a top perspective detail view of a complete suspension trainer in accordance with aspects of the disclosure including the handle system of FIG. 1.

As best shown in FIG. 3 herein, there is generally shown a suspension trainer, identified by reference numeral 10, for use as an exercise apparatus. The suspension trainer 10 includes at least one user support strap(s) 12, 14 and attachment elements 16. In accordance therewith, the attachment elements 16 may be removably connected to end loop(s) 17, 19 in the support strap(s) 12, 14. The suspension trainer 10 is configured to be secured to a static object or additional straps. The straps 12, 14 may be made from flexible, resilient materials such as cloth, rubber, mesh, elastic, plastic, or leather, for example. The straps 12, 14 should be made of materials capable of safely and securely supporting the weight of the user. The attachment elements 16 may be typically made from a material such as metal, for example, capable of withstanding the body weight of the user when the suspension trainer 10 is in use. In certain embodiments, the attachment elements 16 are carabiner clips or other fasteners. The attachment elements 16 are capable of connecting the suspension trainer 10 to the static object (not shown). The attachment elements 16 may be integral with the straps 12, 14 or may be separate components.

Figure 2:
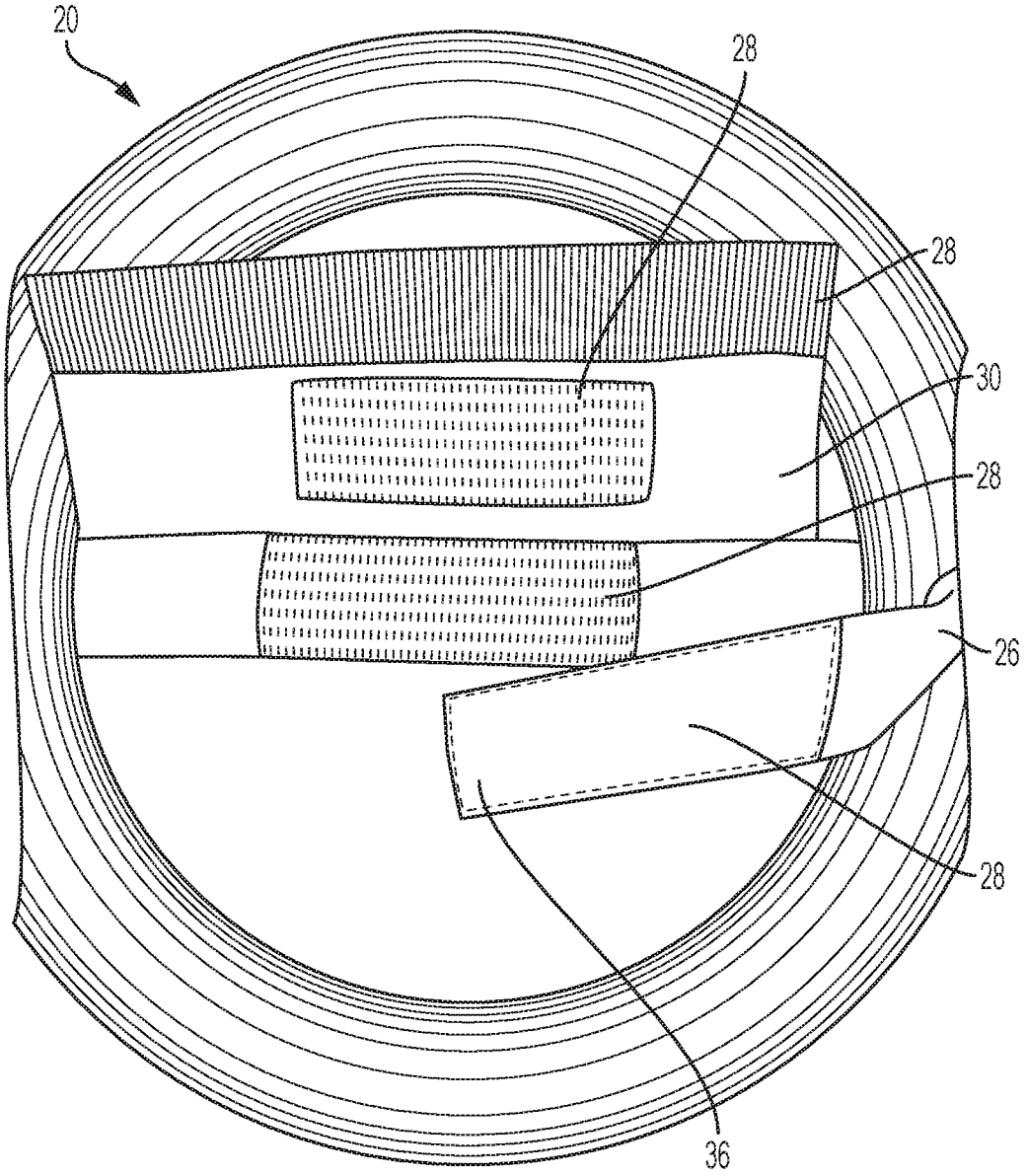
FIG. 2 is a top perspective detail view of the handle system of FIG. 1.

As best shown in FIGS. 1 and 2, the suspension trainer 10, may include at least one handle system 20 comprised of a ring element 22 and strap element 24. The strap element 24 is preferably comprised of a nylon strap 26 with hook and loop closures 28 and a wrap-around handle portion 30 attached to the strap 26 to provide a secure user gripping surface when wrapped around and secured to the strap 26. Further, the ring element 22 preferably includes two bores 32 therethrough, located on opposite portions of the ring element 22. The bores 32 may include metal grommets 34 therethrough to provide additional strength and rigidity to the bores 32. The bores 32 are preferably sized and shaped to receive the elongate end 36 of the strap 26 therethrough. In use, to attach the strap element 24 to the ring element 22, a user would thread the elongate end 36 of the strap 26 through each bore 32 in the ring element 22 and then double back the end 36, thereby connecting the respective hook and loop closures 28 and thereafter wrapping the wrap-around handle portion 32 therearound. To remove the strap element 24 from the ring element 22, the aforementioned steps would be followed in reverse.

It is noted that the handle system 20 in accordance with the present disclosure, may be made of conventional materials in conventional ways. Specifically, all parts can be made in different lengths, sizes, shapes and materials. For example, the ring element 22 can be made in a hexagon, square, or octagonal shape and in wood, plastic or metal. Similarly, the strap element 24 may be manufactured in plastic or nylon webbing and may be adjustable in any manner including through the use of snaps, buttons, tying, stitching, etc. Additionally, the handle system 20 may be attachable to other portions of the suspension trainer 10, including the straps 12, 14 by way of carabiners, additional straps, loops, stitching or other attachments as is known in the art.

Figure 4A:
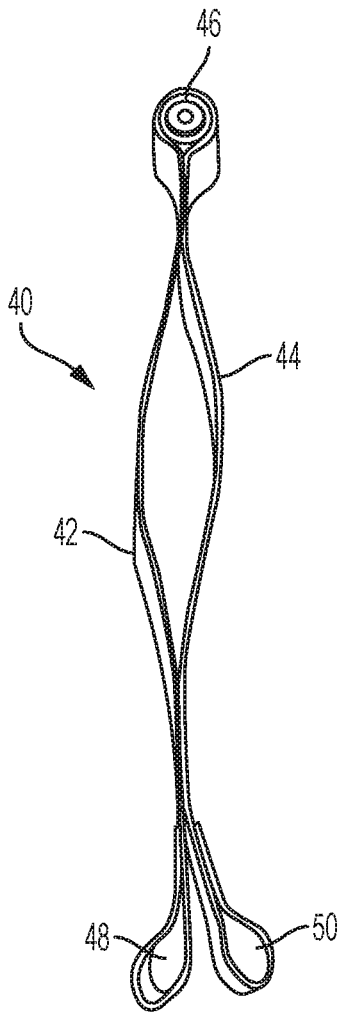
FIGS. 4*a*, 4*b* and 4*c* are detail views of a conversion strap kit for use in connection with a suspension trainer in accordance with aspects of the disclosure to allow the suspension trainer to be used in a doorway.
Figure 4B:
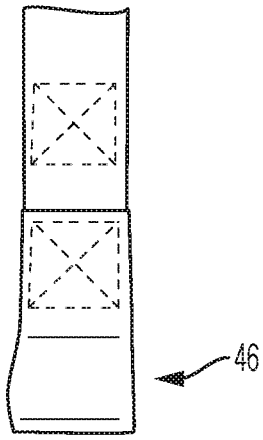
Figure 4C:
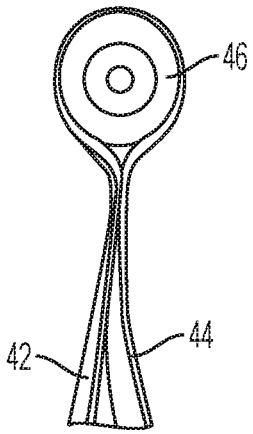

As best shown in FIG. 4, the suspension trainer 10 in accordance with the present disclosure may include a strap system 40 that allows the trainer 10 to be statically connected to a door frame (not shown). Specifically, the strap system 40 may be comprised of a first strap section 42, a second strap section 44 and a stop 46. Further, each strap section 42, 44 may include connection ends 48, 50 for connecting the strap(s) to straps 14, 12 using attachment element(s) 16. Specifically, in use, the attachment element(s) 16 may be threaded through connection ends 48, 50 and stop 46 may be placed on the opposite side of a door frame (not shown). The door (not shown) may then be shut providing a static arrangement for suspension trainer 10.

The suspension trainer 10 of the present disclosure may be operated by a user in many different ways and in many different exercises. The straps 12, 14 are adapted to be secured to a static attachment by either directly attaching to a static object through attachment element(s) 16 or through use of the strap system 40 as discussed above. Such static attachment points may include outwardly away from a door, a door frame, a wall, or other secure, substantially rigid object. Next, the user would choose whether to use the ring element 22 by itself or with the strap element 24. If the strap element 24 is desired, it would be attached to the ring element as discussed above. After that, the user may attach the adjustable straps 12, 14 to themselves by way of attachment mechanisms 13, 15 such as a carabiner. Next, the user may adjust the straps 12, 14 to the desired height and stiffness. Lastly, the user would put their hand, foot, elbow, etc. into the handle system 20 as desired to perform the desired exercise.

The suspension trainer 10 of the present disclosure may be made through standard fabrication methods as would be known in the art. Further, the suspension trainer 10 of the present disclosure may be used in multiple fields including, but not limited to, medical, construction, and industrial fitness applications.

The various aspects and embodiments disclosed herein are for purposes of illustration and are not intended to be limiting, with the true scope and spirit being indicated by the following claims. Specifically, it is noted that while a resistance band is described as the elongate, flexible apparatus in the pictured embodiments, the disclosure is explicitly not limited to such embodiment and includes straps, jump ropes, etc. as well.

What is claimed is:

1. An exercise system comprising:

an elongate flexible exercise apparatus comprised of a first strap section having a first end and a second end, a second strap section having a first end and a second end, and a stop, the first and second strap sections being connected to the stop at first ends thereof; and a handle system operably connected to the second ends of the first and second strap sections, the handle system comprised of a ring having at least two bores therein through the ring located on opposite sides of the ring, the bores shaped to receive a handle strap therethrough to form a handle in the center of the ring, the handle strap being comprised of a single strap having two ends having hook and loop material attached to the ends thereof in order to allow the strap ends to be attached to themselves.

2. The exercise system of claim 1 wherein said ring is made from wood.

3. The exercise system of claim 1 wherein said bores include grommets therethrough.

* * * * *